United States Patent [19]

Gartside et al.

[11] Patent Number: 4,552,645

[45] Date of Patent: Nov. 12, 1985

[54] PROCESS FOR CRACKING HEAVY HYDROCARBON TO PRODUCE OLEFINS AND LIQUID HYDROCARBON FUELS

[75] Inventors: Robert J. Gartside, Wellesley, Mass.; Axel R. Johnson, North Babylon, N.Y.; Joseph L. Ross, Houston, Tex.

[73] Assignee: Stone & Webster Engineering Corporation, Boston, Mass.

[21] Appl. No.: 587,952

[22] Filed: Mar. 9, 1984

[51] Int. Cl.[4] ..... C10G 51/06; C10G 57/00

[52] U.S. Cl. ..... 208/80; 208/50; 208/106; 208/127

[58] Field of Search ..... 208/80, 50, 106, 127, 208/78; 585/300, 304

[56] References Cited

U.S. PATENT DOCUMENTS

| | | | |
|---|---|---|---|
| 2,871,183 | 1/1959 | Smith et al. | 585/650 |
| 3,172,840 | 3/1965 | Paterson | 208/80 |
| 3,193,486 | 7/1965 | Payne | 208/50 |
| 3,254,020 | 5/1966 | Frayer et al. | 208/80 |
| 3,907,664 | 9/1975 | Janssen et al. | 208/80 |
| 4,040,943 | 8/1977 | Stolfa | 208/80 |
| 4,097,363 | 6/1978 | McKinney et al. | 208/78 |
| 4,192,734 | 3/1980 | Pavlica et al. | 208/80 |
| 4,227,990 | 10/1980 | Dearth et al. | 208/127 |
| 4,318,800 | 3/1982 | Woebcke et al. | 208/127 |
| 4,437,979 | 3/1984 | Woebcke et al. | 208/127 |

*Primary Examiner*—D. E. Gantz
*Assistant Examiner*—Anthony McFarlane
*Attorney, Agent, or Firm*—Hedman, Gibson, Costigan & Hoare

[57] ABSTRACT

A process for cracking heavy hydrocarbon feedstocks by separation into light and heavy fractions and concommitantly thermally cracking the light fraction and coking the heavy fraction.

10 Claims, 4 Drawing Figures

PROCESS FOR CRACKING HEAVY HYDROCARBON TO PRODUCE OLEFINS AND LIQUID HYDROCARBON FUELS

FIELD OF THE INVENTION

This invention relates to the production of olefins and liquid hydrocarbon fuels from heavy hydrocarbons. More particularly, the invention relates to the production of olefins in a thermal cracking environment.

DESCRIPTION OF THE PRIOR ART

It has long been known that naturally occurring hydrocarbons can be cracked at high temperatures to produce olefins and liquid fuel. Both catalytic and non-catalytic cracking processes exist to produce olefins and hydrocarbon fuel from heavy naturally occurring hydrocarbons.

It has been desirable to use the lighter molecular weight and lower boiling naturally occurring hydrocarbons, such as gas oils, to produce olefins and gasoline. The lighter hydrocarbons typically contain fewer contaminants than heavy hydrocarbons.

However, as lighter hydrocarbons are consumed, the petroleum and petro chemical industry has had to focus on the use of heavier hydrocarbons, such as residual oils. Residual oils are customarily identified as residual, reduced crude oils, atmospheric tower bottoms, vacuum residual oils topped crudes and most hydrocarbons heavier than gas oils. The problem with the residual oils is that the residual oils contain contaminants, such as sulfur and metals. Heavy metals are particularly troublesome in catalytic cracking operations. The heavy hydrocarbons also contain a greater abundance of coke precursors (asphaltenes, polynuclear aromatics, etc.). These coke precursors tend to convert to coke during the cracking operation and tend to foul the equipment and catalyst or inert particles used in the cracking process.

Many methods have been developed to deal with the problem of cracking residual oils, generally by pretreating the residual oil before cracking. Solvent deasphalting, fluid or delayed coking or hydrotreating are residual feed pretreating processes. The solvent deasphalting, fluid or delayed coking processes are essentially carbon rejection processes which result in a substantial loss of feedstock. Hydrotreating typically takes a very heavy toll on the economics of the processing by virtue of the poisonous effect of the contaminants on the catalyst and on the consumption of hydrogen.

SUMMARY OF THE INVENTION

It is an object of the present invention to crack heavy hydrocarbon to produce olefins and liquid fuels.

It is a further object of the present invention to crack atmospheric tower bottoms by first processing the atmospheric tower bottoms through a vacuum tower and separately cracking the vacuum oil and the vacuum resid.

The process of the present invention proceeds essentially in a thermal cracking process. The feed, i.e., atmospheric tower bottom, is separated in a vacuum tower into a vacuum gas oil and vacuum resid. The vacuum gas oil is delivered to a thermal cracking reactor and passed through with particulate solids at high temperatures, i.e., 1500° F. and low residence times, i.e., 0.05 to 0.40 seconds to crack the hydrocarbon into olefins. The olefins are separated from the particles in a separator and taken overhead from the separator. The solids are delivered to a stripper/coker. At the same time, the vacuum resid from the bottom of the vacuum tower is delivered to the coker stripper and therein cracked at high severity producing a cracked gas and a small amount of coke relative to a traditional coker. The particulate solids are regenerated by combusting coke made in the cracking process and returned to the thermal cracking reactor for repetitive cracking.

DESCRIPTION OF THE DRAWINGS

The process of the present invention will be better understood when considered with the following drawings wherein.

DESCRIPTION OF THE PREFERRED EMBODIMENT

The process of the present invention is directed to producing olefins and liquid fuels from a heavy hydrocarbon feed. Atmospheric tower bottoms (ATB) are well suited for processing by the process of the present invention. However, any heavy feed that can be separated into a light and heavy stream can be processed by the present invention.

Figure 1:
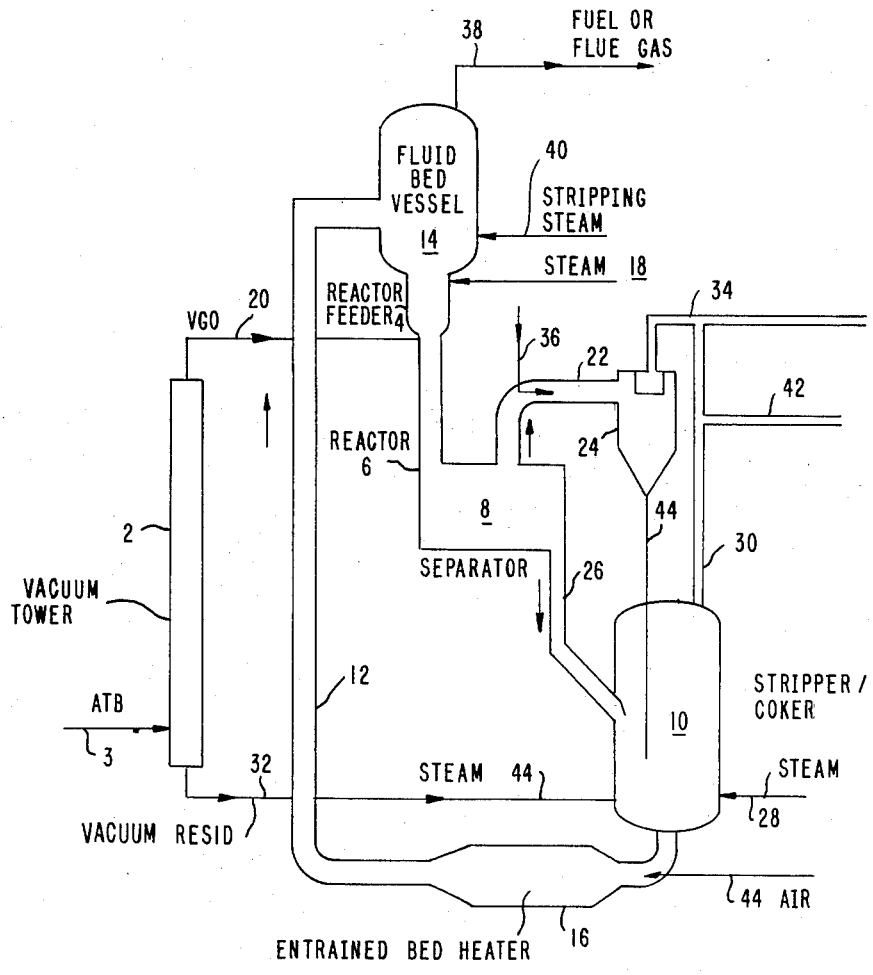
FIG. 1 is a schematic view of the process of the present invention.

As best seen in FIG. 1, the system is comprised essentially of a vacuum tower 2 and a thermal regenerative cracking assembly. The thermal regenerative cracking assembly is comprised of a thermal regenerative cracking reactor 6, a reactor feeder 4, a separator 8 and a coke stripper vessel 10. The system also includes means for regenerating solids particles separated from the cracked product after the reaction. The system shows illustratively an entrained bed heater 16, a transport line 12 and a fluid bed vessel 14 in which the solids can be regenerated.

In the process of the present invention, atmospheric tower bottoms are delivered through line 3 to a conventional vacuum tower 2 (operated at about 20 millimeters) wherein the atmospheric tower bottoms (ATB) are separated into a light overhead vacuum oil stream and a heavier bottoms vacuum resid. The vacuum gas oil is condensed and then passed through line 20 to the thermal regenerative cracking reactor 6.

Figure 2:
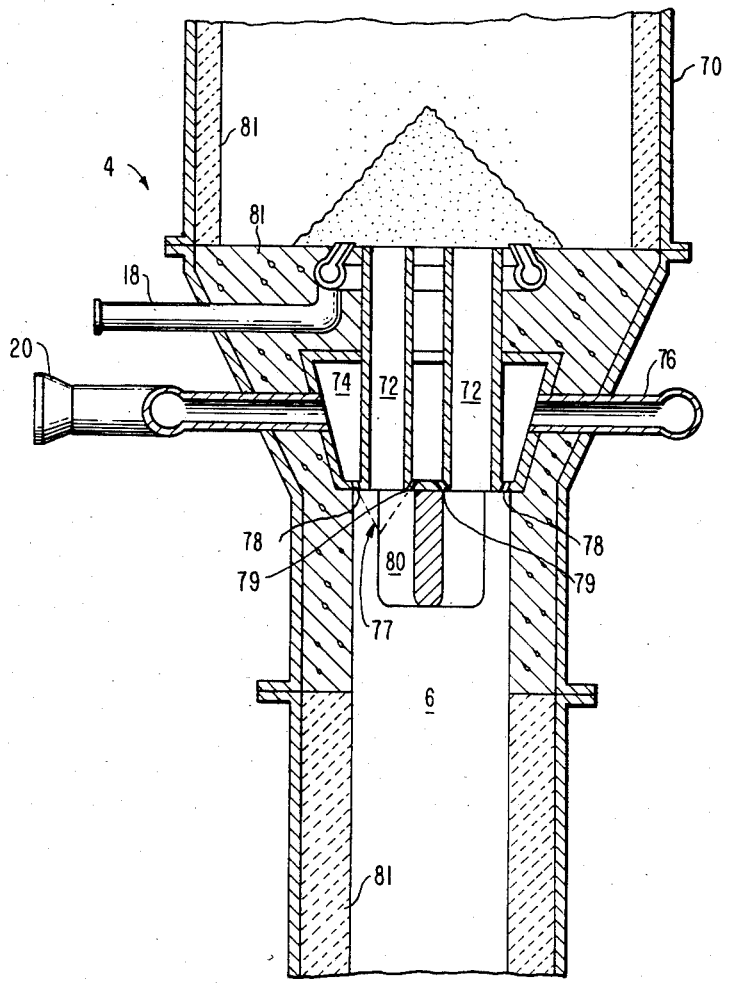
FIG. 2 is a cross-sectional elevational view of the reactor feeder in the thermal regenerative (TRC) system.

The vacuum gas oil is delivered to the reactor 6 with hot solids particles that are passed through the reactor feeder 4 (best seen in FIG. 2). Immediate intimate mixing of the hot solids and the vacuum gas oil occurs in the reactor and cracking proceeds immediately. The temperature of the solids entering the reactor is in the range of 1750° F. The vacuum gas oil is delivered to the reactor at approximately 700° F. The solids to feed weight ratio is 5 to 60, and the reaction proceeds at 1500° F. for a residence time of about 0.05 to 0.40 seconds, preferably form 0.20 to 0.30. The product gases are separated from the solids in separator 8 (best seen in FIG. 3) and the product gases pass overhead through a line 22 and are immediately quenched with typical quench oil that is delivered to line 22 through line 36.

The quenched product is passed through a cyclone 24 where entrained solids are removed and delivered through line 44 to the coker stripper 10.

The separated solids leave the separator 8 through line 26 and pass to the stripper coker 10. At the same time, vacuum resid from line 32 is delivered to the stripper/coker 10 and is cracked by the solids which are now at a temperature of approximately 1300° F. to 1600° F. The weight ratio of solids to vacuum resid in the stripper/coker ranges from 5 to 1 to 60 to 1. Thus, the vacuum resid is elevated to a temperature of 950° F.–1250° F. The vaporized product from the vacuum resid is taken overhead through line 30 and either delivered for processing in line 34 or taken directly out of the system through line 42.

The solids which have accumulated coke in both the tubular reactor 6 and the stripper/coker 10 are passed to the entrained bed heater 16 and combusted with air delivered to the system through line 44 to provide the heat necessary for thermal regenerative cracking in the reactor 6.

The reactor feeder of the TRC processing system is particularly well suited for use in the system due to the capacity to rapidly admix hydrocarbon feed and particulate solids. As seen in FIG. 2, the reactor feeder 4 delivers particulate solids from a solids receptacle 70 through vertically disposed conduits 72 to the reactor 6 and simultaneously delivers hydrocarbon feed to the reactor 6 at an angle into the path of the particulate solids discharging form the conduits 72. An annular chamber 74 to which hydrocarbon is fed by a toroidal feed line 76 terminates in angled openings 78. A mixing baffle or plug 80 also assists in effecting rapid and intimate mixing of the hydrocarbon feed and the particulate solids. The edges 79 of the angled openings 78 are preferably convergently beveled, as are the edges 79 at the reactor end of the conduits 72. In this way, the gaseous stream from the chamber 74 is angularly injected into the mixing zone and intercepts the solids phase flowing from conduits 78. A projection of the gas flow would form a cone shown by dotted lines 77, the vortex of which is beneath the flow path of the solids. By introducing the gas phase angularly, the two phases are mixed rapidly and uniformly, and form a homogeneous reaction phase. The mixing of a solid phase with a gaseous phase is a function of the shear surface between the solids and gas phases, and the flow area. As ratio of shear surface to flow area (S/A) of infinity defines perfect mixing; poorest mixing occurs when the solids are introduced at the wall of the reaction zone. In the system of the present invention, the gas stream is introduced annularly to the solids which ensures high shear surface. By also adding the gas phase transversely through an annular feed means, as in the preferred embodiment, penetration of the phases is obtained and even faster mixing results. By using a plurality of annular gas feed points and a plurality of solid feed conduits, even greater mixing is more rapidly promoted, since the surface to area ratio for a constant solids flow area is increased. Mixing is also a known function of the L/D of the mixing zone. A plug creates an effectively reduced diameter D in a constant L, thus increasing mixing.

The plug 80 reduces the flow area and forms discrete mixing zones. The combination of annular gas addition around each solids feed point and a confined discrete mixing zone greatly enhances the conditions for mixing. Using this preferred embodiment, the time required to obtain an essentially homogenous reaction phase in the reaction zone is quite low. Thus, this preferred method of gas and solids addition can be used in reaction systems having a residence time below 1 second, and even below 100 milliseconds.

Because of the environment of the reactor 6 and reactor feeder 4, the walls are lined with an inner core 81 of ceramic material. The detail of the reactor feeder is more fully described in U.S. Pat. No. 4,388,187, which is incorporated herein by reference.

Figure 3:
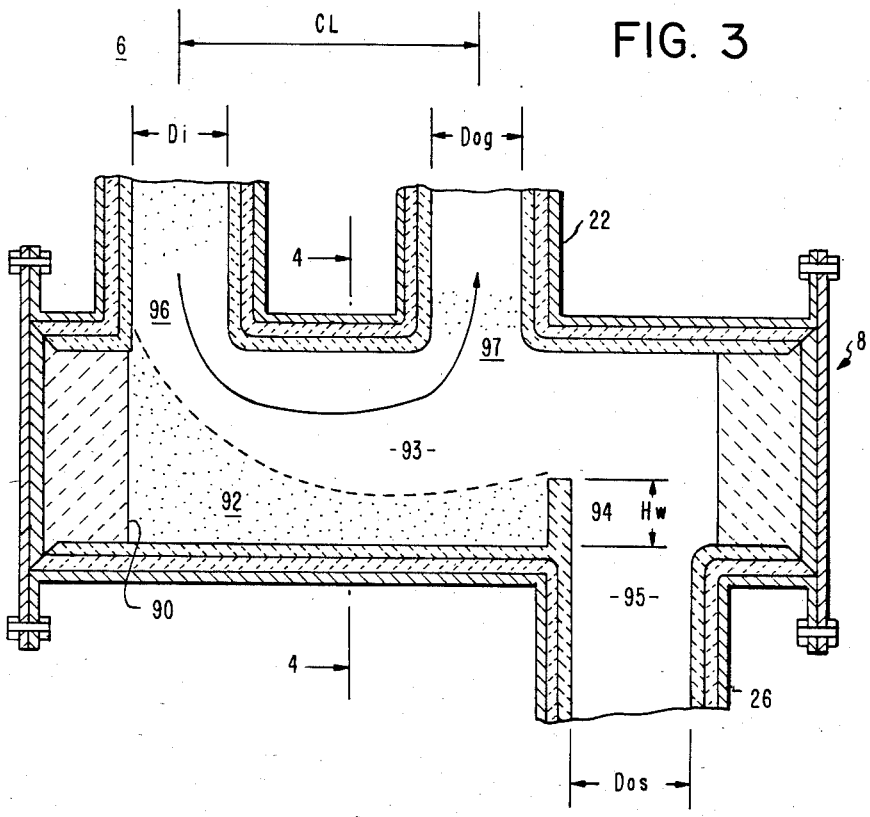
FIG. 3 is cross-sectional elevational view of the separator of the thermal regenerative cracking process.

The separator 8 of the TRC system seen in FIG. 3, can also be relied on for rapid and discrete separation of cracked product and particulate solids discharging from the reactor 6. The inlet to the separator 8 is directly above a right angle corner 90 at which a mass of particulate solids 92 collect. A weir 94 downstream from the corner 90 facilitates accumulation of the mass of solids 92. The gas outlet 22 of the separator 8 is oriented 180° from the separator gas-solids inlet 96 and the solids outlet 26 is directly opposed in orientation to the gas outlet 22 and downstream of both the gas outlet 22 and the weir 94. In operation, centrifugal force propels the solid particles to the wall opposite inlet 96 of the chamber 93 while the gas portion having less momentum, flows through the vapor space of the chamber 93. Initially, solids impinge on the wall opposite the inlet 96 but subsequently accumulate to form a static bed of solids 92 which ultimately form in a surface configuration having a curvilinear arc of approximately 90° of a circle. Solids impinging upon the bed 92 are moved along the curvilinear arc to the solids outlet 95, which is preferably oriented for downflow of solids by gravity. The exact shape of the arc is determined by the geometry of the particular separator and the inlet stream parameters such as velocity, mass flowrate, bulk density, and particle size. Because the force imparted to the incoming solids is directed against the static bed 92 rather than the separator 8 itself, erosion is minimal. Separator efficiency, defined as the removal of solids from the gas phase leaving through outlet 97 is, therefore, not affected adversely by high inlet velocities, up to 150 ft./sec., and the separator 8 is operable over a wide range of dilute phase densities, preferably between 0.1 and 10.0 lbs./ft$^3$. The separator 8 of the present invention achieves efficiencies of about 80%, although the preferred embodiment, can obtain over 90% removal of solids.

It has been found that separator efficiency is dependent upon separator geometry, and more particularly, the flow path must be essentially rectangular, and there is an optimum relationship between the height H and the sharpness of the U-bend in the gas flow.

It has been found that for a given height H of chamber 93, efficiency increases as the 180° U-bend between inlet 96 and outlet 97 is brought progressively closer to inlet 96. Thus, for a given H the efficiency of the separator increases as the flow path decreases and, hence, residence time decreases. Assuming an inside diameter D of inlet 96, the preferred distance CL between the centerlines of inlet 96 and outlet 97 is not greater than 4.0 $D_i$, while the most preferred distance between said centerlines is between 1.5 and 2.5 $D_i$. Below 1.5 $D_i$ better separation is obtained but difficulty in fabrication makes this embodiment less attractive in most instances. Should this latter embodiment be desired, the separator 8 would probably require a unitary casting design because inlet 96 and outlet 97 would be too close to one another to allow welded fabrication.

It has been found that the height of flow path H should be at least equal to the value of $D_i$ or 4 inches in height, whichever is greater. Practice teaches that if H is less than $D_i$ or 4 inches the incoming stream is apt to disturb the bed solids 92 thereby reentraining solids in the gas product leaving through outlet 97. Preferably H is on the order of twice $D_i$ to obtain even greater separation efficiency. While not otherwise limited, it is apparent that too large an H eventually merely increases residence time without substantive increases in efficiency. The width W of the flow path is preferably between 0.75 and 1.25 times $D_i$ most preferably between 0.9 and 1.10 $D_i$.

Outlet 97 may be of any inside diameter. However, velocities greater than 75 ft./sec. can cause erosion because of residual solids entrained in the gas. The inside diameter of outlet 97 should be sized so that a pressure differential between the stripping vessel 10 shown in FIG. 1 and the separator 8 exist such that a static height of solids is formed in solids outlet line 26. The static height of solids in line 26 forms a positive seal which prevents gases from entering the stripping vessel 10. The magnitude of the pressure differential between the stripping vessel 10 and the separator 8 is determined by the force required to move the solids in bulk flow to the solids outlet 95 as well as the height of solids in line 26. As the differential increases the net flow of gas to the stripping vessel 10 decreases. Solids, having gravitational momentum, overcome the differential, while gas preferentially leaves through the gas outlet.

Figure 4:
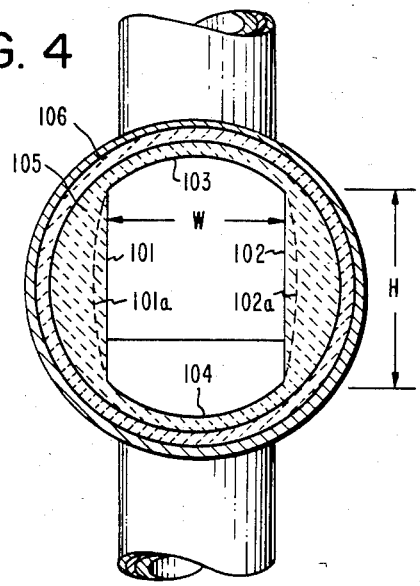
FIG. 4 is a sectional view through line 4—4 of FIG. 3.

FIG. 4 shows a cutaway view of a the separator along section 4—4 of FIG. 3. It is essential that longitudinal side walls 101 and 102 should be rectilinear, or slightly arcuate as indicated by the dotted lines 101*a* and 102*a*. Thus, the flow path through the separator 8 is essentially rectangular in cross section having a height H and width W as shown in FIG. 4. The embodiment shown in FIG. 4 defines the geometry of the flow path by adjustment of the lining width for walls 101 and 102. Alternatively, baffles, inserts, weirs or other means may be used. In like fashion the configuration of walls 103 and 104 transverse to the flow path may be similarly shaped, although this is not essential.

The separator shell and manways are preferably lined with erosion resistent linings 105, which may be required if solids at high velocities are encountered. Typical commercially available materials for erosion resistent lining include Carborundum Precast Carbofrax D, Carborundum Precast Alfrax 201 or their equivalent. A thermal insulation lining 106 may be placed between the shell and the lining 105 and between the manways and their respective erosion resistent linings when the separator is to be used in high temperatures service. Thus, process temperatures above 1500° F. (870° C.) can be used.

The detail of the separator 8 is more fully described in U.S. Pat. No. 4,288,235 which is incorporated herein by reference.

The following example illustrates the process of the present invention. An atmospheric tower bottoms (ATB) having essentially % vacuum resid (VR) and 56% vacuum gas oil (VGO) are cracked separately with the following yields:

| | VGO (TRC) % | VR (stripper/coker) % |
|---|---|---|
| Gas | 10.7 | 15 |
| $C_2$ | 24.6 | 14 |
| $C_3$ | 10.5 | 7 |
| $C_4$ | 7.6 | 4 |
| CR Gaso | 15.5 | 10 |
| LFO | 11.6 | 6 |
| HFO | 16.6 | 34 |
| Coke | 2.9 | 10 |

62,700 pounds/hr of atmospheric tower bottoms are delivered through line 3 to the vacuum tower 2. 35,100 pounds of vacuum gas oil is taken from the vacuum tower 2 to line 20 and 27,600 pounds per hour of vacuum resid is taken through line 32. The vacuum gas oil is delivered to the reactor 6 and cracked with particulate solids which have been elevated in temperature to 1750° F. The solids to hydrocarbon feed ratio by weight is 22. Cracking proceeds at 1500° F. for 0.20 seconds. Approximately 1018 pounds per hour of coke is produced on the particles in the reactor 6.

The 27,600 pounds per hour of vacuum resid is delivered to the coker 10 at approximately 650° F. Therein 2760 pounds per hour of coke is produced. The total coke produced in the system is 3778 pounds. All the coke produced and supplemental heavy fuel oil are burned to supply the heat for the process. The over all combined yield from the process is:

| | | Wt % | lb/in |
|---|---|---|---|
| Combined yield: | Gas | 12.6 | 7900 |
| | Ethylene | 19.9 | 12500 |
| | Propylene | 9.0 | 5640 |
| | $C_4$ | 6.0 | 3760 |
| | Cr. Gas | 13.1 | 8210 |
| | LFO | 9.1 | 5710 |
| | HFO | 24.3 | 15240 |
| | Coke | 6.0 | 3780 |

We claim:

1. A process for the production of olefins or light hydrocarbon fuels comprising the steps of:

(a) separating a heavy hydrocarbon into a light hydrocarbon fraction and a heavy hydrocarbon fraction;

(b) thermally cracking the light hydrocarbon fraction with heat supplied by hot particulate solids;

(c) separating the cracked product from the hot particulate solids;

(d) delivering the separated particulate solids to a stripper/coker;

(e) introducing the heavy hydrocarbon into the stripper/coker to produce vaporized hydrocarbon and coke;

(f) combusting coke produced in the reactor and stripper/coker to heat the particulate solids, (g) returning the heated particulate solids to the thermal cracking reactor.

2. A process as in claim 1, wherein the thermal cracking temperature is about 1500° F., the ratio of solids to light hydrocarbon by weight is between 5 and 60, and the reaction residence time is 0.05 to 0.50 seconds.

3. A process as in claim 2, wherein the temperature of the solids delivered to the stripper/coker is between 1300° F. and 1600° F.; the coking temperature is 950° F. to 1250° F.

4. A process as in claim 3, wherein the ratio of solids to heavy hydrocarbon feed by weight in the coker is 5 to 60.

5. A process as in claim 2, wherein the heavy hydrocarbon is residual oil.

6. A process as in claim 2, wherein the heavy hydrocarbon is an atmospheric tower bottoms.

7. A process as in claim 2, wherein the light hydrocarbon feed and hot particulate solids are delivered to a tubular thermal regenerative cracking reaction through a reactor feeder having vertical passages communicating with the tubular regenerative cracking reactor and the solids in a hot solids vessel, means for providing localized fluidization to the solids above the vertical passages and means for delivering the light hydrocarbon fraction to the tubular thermal regenerative reactor at an angle to the path of the particulate solids entering the thermal regenerative reactor.

8. A process as in claim 1 wherein the hot particulate solids and the thermally cracked product gases are separated in a separator wherein the particulate solids and thermally cracked product gases enter the separator through a separator inlet and reverse direction ninety degrees; the cracked product gases reverse direction another ninety degrees to effect a one hundred eighty degree reversal in direction from the entry direction; the particulate solids continue in the path oriented ninety degrees from the particulate solids-cracked product gas separator inlet and thereafter, the path of the particulate solids is directed downwardly.

9. A process as in claim 1 wherein the particulate solids and cracked product gases are separated in a separator comprising a chamber for rapidly disengaging about 80% of the particulate solids from the incoming mixed phase stream, said chamber having approximately rectilinear longitudinal side walls to form a flow path of height H and width W approximately rectangular in cross section, said chamber also having a mixed phase inlet of inside width $D_i$ a gas outlet and a solids outlet, said inlet being at one end of the chamber and disposed normal to the flow path the height H of which is equal to at least $D_i$; or 4 inches, whichever is greater, and the width W of which is no less than 0.75 $D_i$ but no more than 1.25 $D_i$ said solids outlet being at the opposite end of the chamber and being suitably arranged for downflow of discharged solids by gravity, and said gas outlet being therebetween at a distance no greater than 4D from the inlet as measured between respective centerlines and oriented to effect a 180° change in direction of the gas whereby resultant centrifugal forces direct the solid particles in the incoming stream toward a wall of the chamber opposite to the inlet forming thereat and maintaining an essentially static bed of solids, the surface of the bed defining a curvilinear path of an arc of approximately 90° of a circle for the outflow of solids to the solids outlet.

10. A process as in claim 1, wherein the heavy hydrocarbon is separated into a light hydrocarbon fraction and a heavy hydrocarbon fraction by means of a vacuum fractionation column.

* * * * *

UNITED STATES PATENT AND TRADEMARK OFFICE

CERTIFICATE OF CORRECTION

PATENT NO. : 4,552,645

DATED : November 12, 1985

INVENTOR(S) : Robert J. Gartside, Axel R. Johnson and Joseph L. Ross

It is certified that error appears in the above-identified patent and that said Letters Patent is hereby corrected as shown below:

Column 6, line 30, should read

-- Wt % lb/hr --.

Signed and Sealed this

Tenth Day of January, 1989

*Attest:*

DONALD J. QUIGG

*Attesting Officer*

*Commissioner of Patents and Trademarks*